US010837241B2

(12) United States Patent
Horn

(10) Patent No.: US 10,837,241 B2
(45) Date of Patent: Nov. 17, 2020

(54) APPARATUS FOR TRANSMITTING TORQUE THROUGH A WORK STRING WHEN IN TENSION AND ALLOWING FREE ROTATION WITH NO TORQUE TRANSMISSION WHEN IN COMPRESSION

(71) Applicant: DEEPWATER OIL TOOLS LTD., Aberdeen Aberdeenshire (GB)

(72) Inventor: Tristam Horn, Aberdeen (GB)

(73) Assignee: DELTATEK OIL TOOLS LIMITED, Aberdeen (GB)

( * ) Notice: Subject to any disclaimer, the term of this patent is extended or adjusted under 35 U.S.C. 154(b) by 203 days.

(21) Appl. No.: 16/073,190

(22) PCT Filed: Dec. 16, 2016

(86) PCT No.: PCT/GB2016/053954
§ 371 (c)(1),
(2) Date: Jul. 26, 2018

(87) PCT Pub. No.: WO2017/103601
PCT Pub. Date: Jun. 22, 2017

(65) Prior Publication Data

US 2019/0032425 A1 Jan. 31, 2019

(30) Foreign Application Priority Data

Dec. 18, 2015 (GB) ..... 1522428.0

(51) Int. Cl.
*E21B 17/07* (2006.01)
*E21B 33/14* (2006.01)

(52) U.S. Cl.
CPC ..... *E21B 17/073* (2013.01); *E21B 17/07* (2013.01); *E21B 33/14* (2013.01)

(58) Field of Classification Search
CPC ..... E21B 17/07; E21B 17/073; E21B 33/14
See application file for complete search history.

(56) References Cited

U.S. PATENT DOCUMENTS

| | | | | |
|---|---|---|---|---|
| 4,211,290 A * | 7/1980 | Mason | E21B 17/07 175/321 |
| 4,323,128 A * | 4/1982 | Young | F16D 3/065 175/320 |
| 4,394,884 A * | 7/1983 | Skipper | E21B 17/07 175/321 |
| 4,657,092 A * | 4/1987 | Franks, Jr. | E21B 17/18 175/232 |
| 2016/0230479 A1* | 8/2016 | Khaparde | E21B 17/07 |

* cited by examiner

*Primary Examiner* — Yong-Suk (Philip) Ro
(74) *Attorney, Agent, or Firm* — David S. Bradin; Nexsen Pruet, PLLC

(57) ABSTRACT

A system for facilitating the transmission of rotational torque through a tool when the tool is in tension but allowing free rotation without torque transmission when the tool is in compression and stroked partially or fully closed.

19 Claims, 4 Drawing Sheets

APPARATUS FOR TRANSMITTING TORQUE THROUGH A WORK STRING WHEN IN TENSION AND ALLOWING FREE ROTATION WITH NO TORQUE TRANSMISSION WHEN IN COMPRESSION

CROSS-REFERENCE TO RELATED APPLICATIONS

The present application is a National Stage Application under 35 U.S.C. § 371 of PCT/GB2016/053954, filed Dec. 16, 2016, which claims priority to GB Priority Application Number 1522428.0, filed Dec. 18, 2015, the contents of each of which are hereby incorporated by reference in their entireties, for all purposes.

FIELD OF THE INVENTION

The present invention relates to an apparatus, which enables cementing operations to be carried out with an inner work string.

BACKGROUND OF THE INVENTION

The object of the present invention is to provide an apparatus, which enables rotational torque to be transmitted from above the tool to below the tool when in tension and stroked fully open, whilst enabling no torque to be transmitted from above the tool to below the tool when in compression and stroked partially or fully closed.

The present invention is for use in the oil industry, particularly for cementing operations on offshore oil rigs within a work string.

A work string component such as the present invention is made up as part of a number of components attached together via connections. The present invention has connections which enable it to be made up to any work string.

Casing strings are run and cemented into oil wells to facilitate deeper drilling operations to continue, if preferable an inner work string is sometimes run into the casing to facilitate more optimal cementing operations.

The inner work string may be attached to the base of the casing string via a threaded connection or latching collet which requires rotational torque to be transmitted through the string to make up the connection and to break out the connection.

In the case of certain subsea wellhead systems it is required to provide rotational torque to attach components above the inner work string to the casing. In this instance it is required to provide free rotation below these components after the inner work string has been connected to the base of the casing string.

The requirement described dictates a need for a work string component which provides rotational torque when in tension but allows free rotation above the tool without torque transmission when in compression in a partially or fully stroked dosed position.

SUMMARY OF THE INVENTION

There is provided a system comprising: a tool pin connection; a tool box connection below said tool pin connection; an internal barrel extending between said tool pin connection and said tool box connection wherein said internal barrel has a cylindrical profiled section and a splined profile section and a splined torque bushing; wherein, when said splined torque bushing is engaged with said splined profile section, torque is transmitted from the tool box connection to said tool pin connection, and wherein, when said splined torque bushing is engaged with said cylindrical profiled section, no torque is transmitted from said tool box connection to said tool pin connection. Advantageously, the system allows for rotational torque when in tension but allows for free rotation above the tool without torque transmission when in compression in a partially or fully stroked closed position.

DETAILED DESCRIPTION OF THE INVENTION

Generally, an apparatus and a method for using the apparatus, which enables cementing operations to be carried out with an inner work string is disclosed.

A typical cementing operation of a casing string involves pumping of the fluid cement slurry down the internal diameter of the casing string, which exits the base of the casing and returns up the annulus of the casing string. Once sufficient fluid cement slurry has been pumped, a displacement fluid is pumped behind the cement slurry which forces cement slurry out of the internal diameter of the casing string, leaving said displacement fluid internally and said cement slurry externally to the casing string. By use of a smaller diameter inner work string within the casing string, a smaller volume of displacement fluid is required to place all of the cement slurry in the annulus and thereby optimises the cementing operation.

Figure 3:
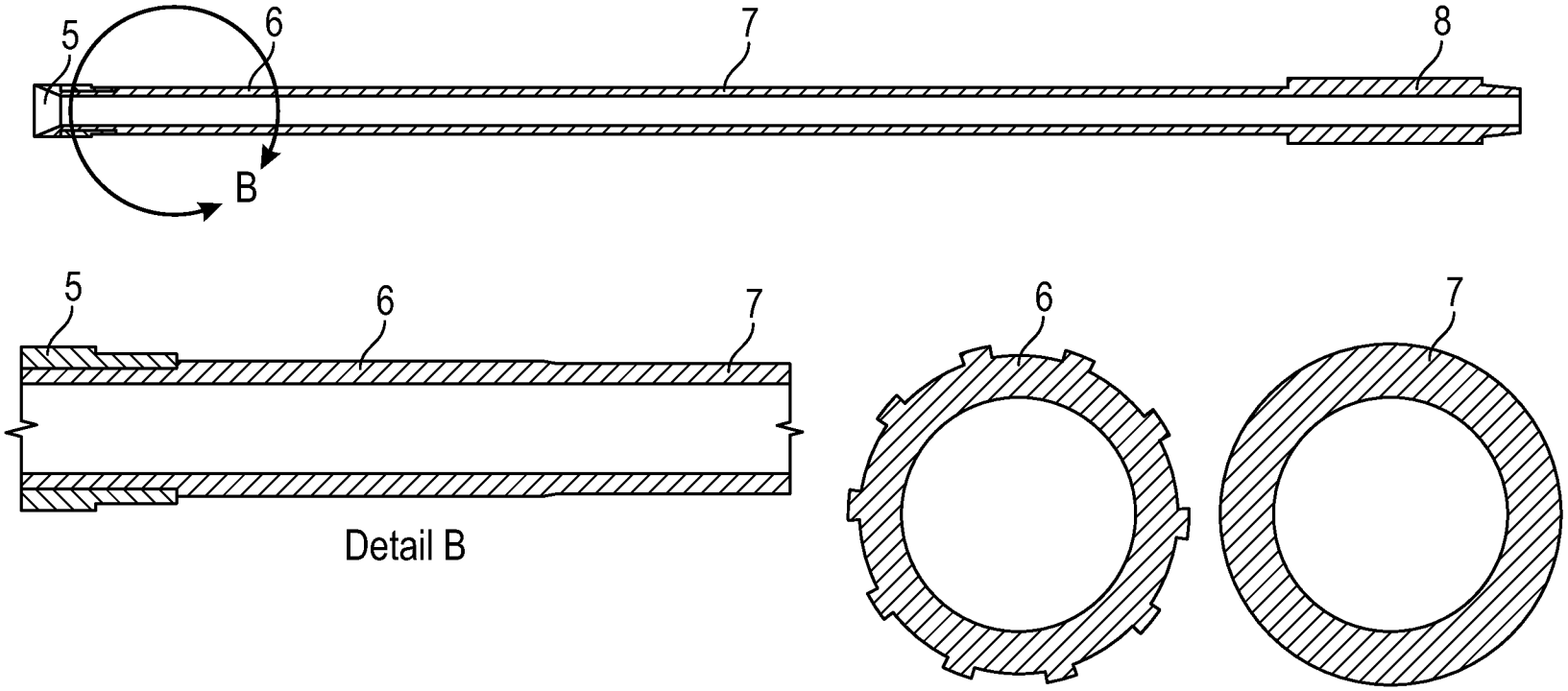
FIG. 3 shows the inner barrel embodiment as well as the internal barrel head of the present invention shown in FIGS. 1 and 2.
Figure 4:
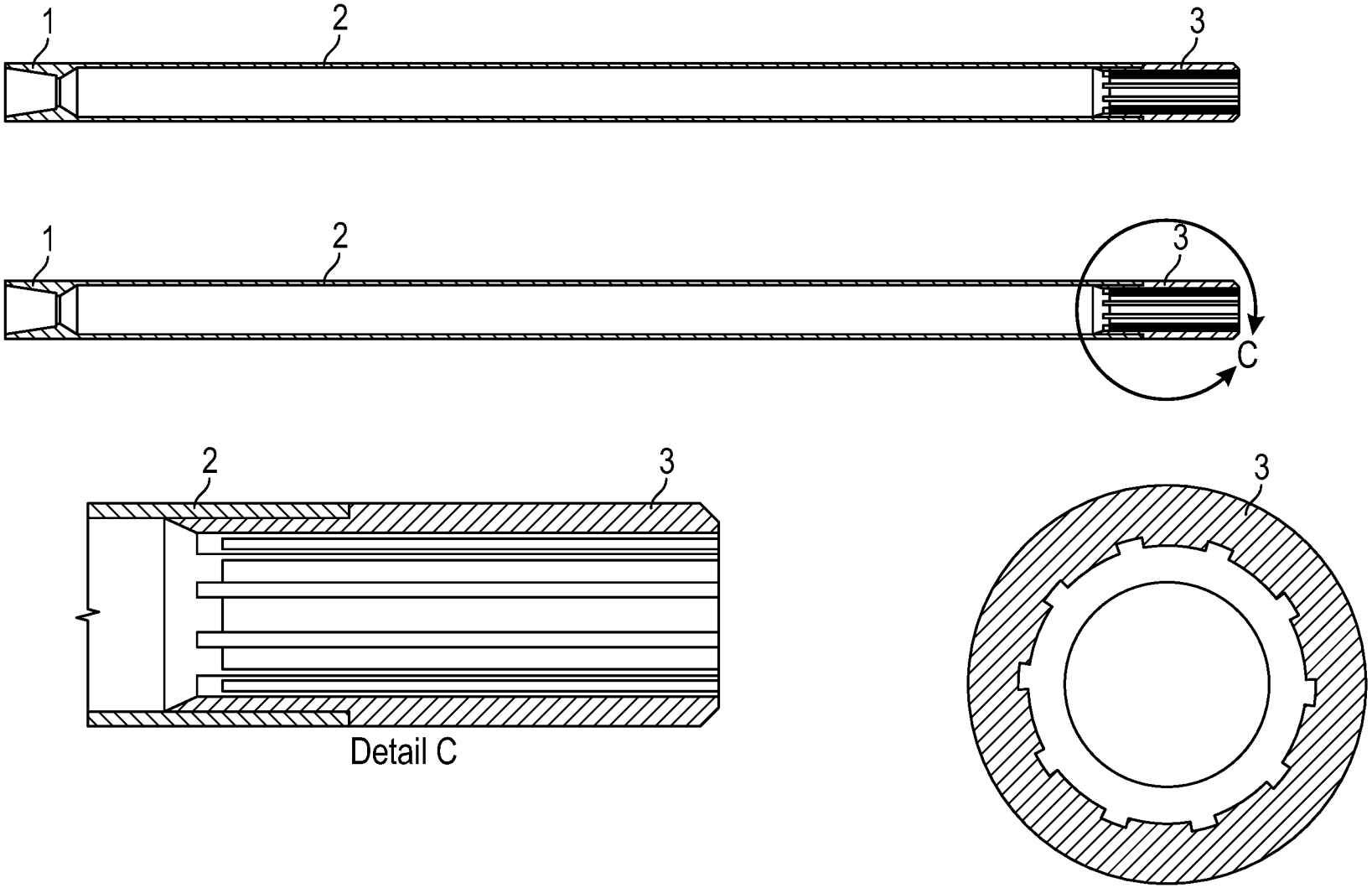
FIG. 4 shows the polished bore receptacle assembly as well as the splined torque bushing of the present invention shown in FIGS. 1 and 2.

With subsea wellhead systems used on offshore oil wells, a running tool is required to be connected to the top of the casing string in order to install the conductor pipe (first casing string for structural support of the rest of the oil well) and surface casing pipe (second casing string run with the wellhead on the top). This running tool creates a point of fixity for the inner work string resulting in an uncertainty of the length of the inner work string. The present invention features a telescoping member comprising an internal barrel 7 and a polished bore receptacle 2. The internal barrel 7 (shown in FIG. 3) can stroke relative to the polished bore receptacle 2 (shown in FIG. 4), providing compensation for a discrepancy between casing string and inner work string length.

Figure 1:
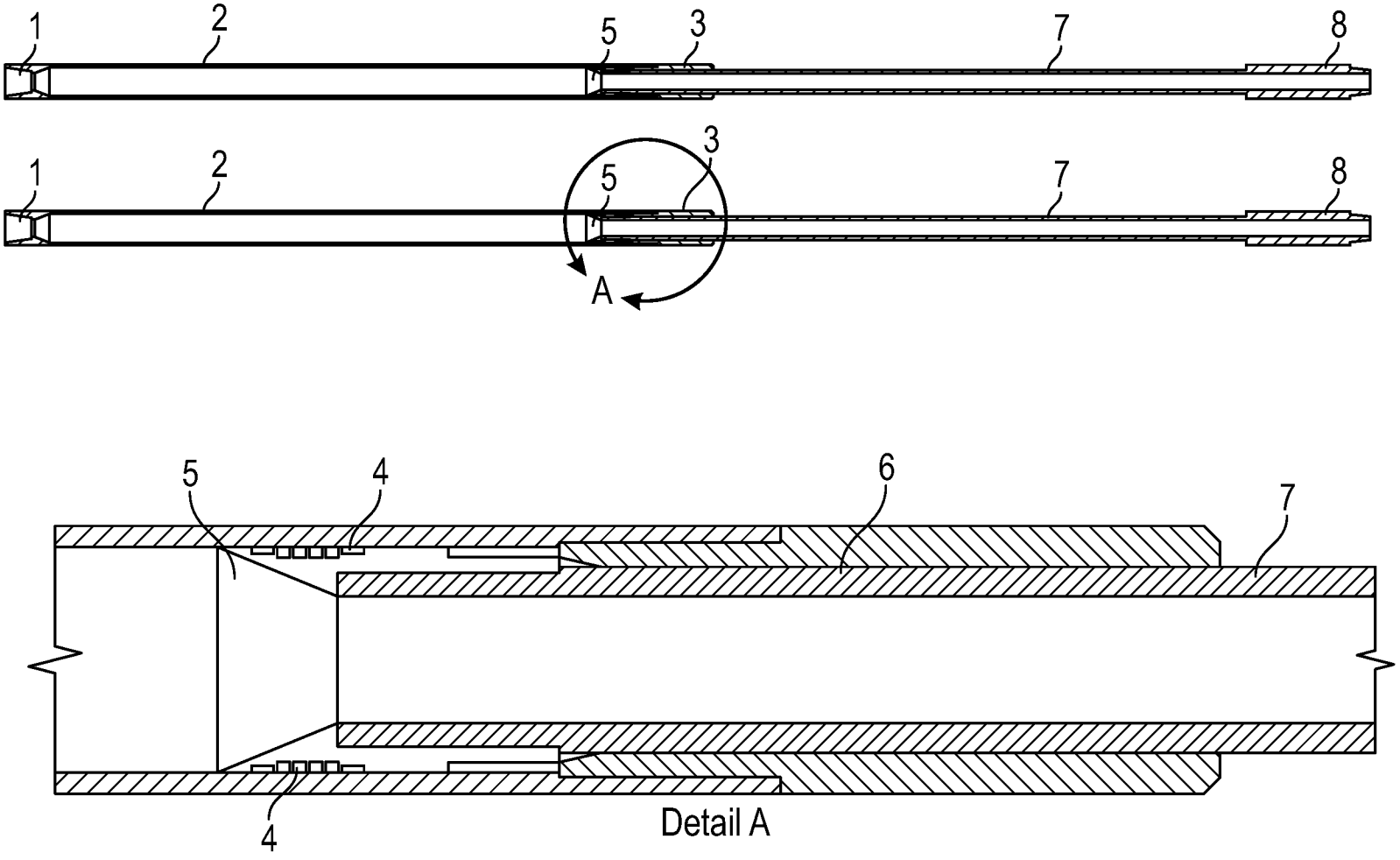
FIG. 1 shows the present invention assembly in tension in a stroked open position, with the ability to transfer torque through the present invention.
Figure 2:
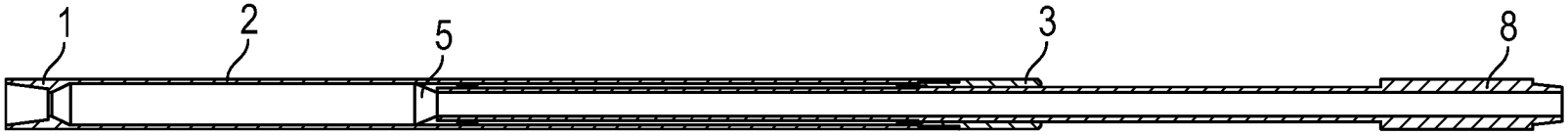
FIG. 2 shows the present invention assembly in compression in a stroked partially closed position, with the ability to free rotate and not transfer torque through the present invention.

During the pumping of a fluid cement slurry an upward force is experienced at the base of the inner work string which unless connected would drive the connection out of the base of the casing string. This is overcome by threading a connection or using a latching collet on the base of the inner work string which positively connects the base of the casing string to the inner work string. This threaded connection or latching collet is made up as the inner work string is run into the casing string and it interacts with the base of the casing string. The present invention is at a position above the base of the inner work string in tension and in a stroked open position. Rotational torque can be transmitted through the present invention as a first connection comprising a box connection 1 (shown in FIG. 1) is rotated from above, transmitting torque through the polished bore receptacle 2 (shown in FIG. 1) and splined torque bushing 3 (shown in FIG. 4) complete with one or more spline profiles. The splined torque bushing 3 (shown in FIG. 1) mates with the splined profile section of the internal barrel 6 (shown in FIG. 3) complete with the one or more spline profiles, typically the same figure as those on the splined torque bushing 3 (shown in FIG. 4), which transmits rotational torque into the cylindrical profile section of the internal barrel 7 (shown in FIG. 3) and through d a second connection comprising a pin connection 8 (shown in FIG. 1). Confirmation of the successful mating of the threaded connection or latching collet at the base of the inner work string with the base of the casing string can be confirmed by means of attempting to pull the inner work string and creating additional tension in the inner work string. The running tool of the casing string can then be lowered into position at the top of the casing string, in turn causing the present invention to undergo a compressional force and stroking partially closed as the internal barrel head 5 (shown in FIG. 2) rides up internally within the polished bore receptacle 2 (shown in FIG. 2). The running tool is required to be rotated to engage the top of the casing string which can be achieved without rotating the inner work string as the splined torque bushing 3 (shown in FIG. 4) is rotating freely around the cylindrical profile section of the internal barrel 7 (shown in FIG. 3), therefore no engagement of the splined profile section of the internal barrel 6 (shown in FIG. 3) with the splined torque bushing 3 (shown in FIG. 4) is established and no torque is transferred through the tool.

The casing string is then run to the required depth using additional pipe, and cementing operations are performed through the additional pipe and inner work string to place cement slurry in the annulus of the casing string. The fluid cement slurry is pumped internally through the inner work string as well as through the present invention which provides pressure containment with a seal stack assembly 4 (shown in FIG. 1) mounted around the internal barrel head 5 (shown in FIG. 1).

Following successful cementing operations, the running tool is removed from the top of the casing string by applying rotational torque. This rotational torque is experienced at box connection 1 (shown in FIG. 1), the polished bore receptacle 2 (shown in FIG. 1) and the splined torque bushing 3 (shown in FIG. 1) of the present invention. This rotational torque is not experienced by the internal barrel 7 (shown in FIG. 3) or the inner work string underneath the pin connection 8 (shown in FIG. 3). This is as a result of the splined torque bushing 3 (shown in FIG. 4) rotating around the cylindrical profile section of the internal barrel 7 (shown in FIG. 3) causing no physical engagement or interaction.

Once the running tool is removed and raised the present invention experiences a tensile force due to the base of the inner string still being engaged at the base of the casing string via the threaded connection or latching collet. This tension in the present invention strokes open the tool and engages the splined torque bushing 3 (shown in FIG. 4) with the splined profile section of the internal barrel 6 (shown in FIG. 3). Rotational torque can now be transmitted through the string from above which will provide rotational torque through the inner work string and disengage the threaded connection or latching collet at the base of the inner work string.

In a preferred embodiment, the material of the tool body, is steel. Of course, the tool box connection 1 (shown in FIG. 1), polished bore receptacle 2 (shown in FIG. 1), splined torque bushing 3 (shown in FIG. 4), internal barrel head 5 (shown in FIG. 1), splined profile section of inner barrel 6 (shown in FIG. 3), cylindrical profile section of inner barrel 7 (shown in FIG. 3) and pin connection 8 (shown in FIG. 3) could be made of other materials, such as X56, L80, P110, 5135, V150 (various grades of steel). The seal stack assembly 4 (shown in FIG. 1) can be any polymer or steel material to provide hydraulic sealing whilst the internal barrel head 5 (shown in FIG. 1) is in various positions within the polished bore receptacle 2 (shown in FIG. 2).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims.

The invention claimed is:

1. Downhole apparatus comprising:

(a) a first connection;

(b) a second connection; and (c) a telescoping member coupling the first connection and the second connection, the telescoping member having a torque-transmitting configuration and a torque-isolating configuration, the telescoping member comprising: a first part including a cylindrical profiled section and a splined profile section, and a second part including a splined torque bushing, wherein with the telescoping member is in the torque-transmitting configuration the splined torque bushing is engaged with the splined profile section, whereby torque is transmittable from the first connection to the second connection via the telescoping member, and with the telescoping member is in the torque-isolating configuration the splined torque bushing is disengaged from the splined profile section and engaged with the cylindrical profiled section, whereby the splined torque bushing is rotatable relative to the cylindrical profiled section and no torque is transmittable from the first connection to the second connection via the telescoping member.

2. The downhole apparatus of claim 1, wherein the cylindrical profiled section and the splined profile section are provided on an internal barrel of the first part of the telescoping member.

3. The downhole apparatus of claim 1, wherein the torque-transmitting configuration of the telescoping member is a stroked open configuration and the torque-isolating configuration of the telescoping member is a stroked closed configuration.

4. The downhole apparatus of claim 1, wherein the first connection is one of a pin connection and a box connection, and the second connection is one of a pin connection and a box connection.

5. The downhole apparatus of claim 1, wherein the splined profile section of the first part of the telescoping member has axially extending spline teeth which extend radially from a body, and the splined torque bushing of the second part of the telescoping member has axially extending spline grooves which extend radially into a cylindrical surface, and when the telescoping member is in the torque-transmitting configuration the axially extending spline teeth are located in the axially extending spline grooves, and when the telescoping member is in the torque-isolating configuration the cylindrical profiled section of the first part of the telescoping member is engaged with the cylindrical surface of the splined torque bushing of the second part of the telescoping member.

6. The downhole apparatus of claim 1, wherein the telescoping member is tubular and one of the first part of the telescoping member and the second part of the telescoping member includes a seal stack assembly and the other of the first part of the telescoping member and the second part of the telescoping member includes a polished bore receptacle cooperating with the seal stack assembly, the seal stack assembly and the polished bore receptacle being relatively axially translatable and providing pressure containment for the tubular member.

7. The downhole apparatus of claim 1, wherein the splined profile section of the first part of the telescoping member has a cylindrical body with axially extending spline teeth thereon and the splined torque bushing of the second part of the telescoping member has a cylindrical bushing body with axially extending bushing spline grooves therein.

8. An assembly for running and cementing a casing string in a drilled bore, the assembly comprising: a casing string having an upper end and a lower end; an inner work string incorporating the downhole apparatus of claim 1 towards a lower end thereof, the inner work string extending through the casing string between the upper end and the lower end of the casing string; a connection at a lower end of the inner work string; and a casing running tool coupled to an upper end of the inner work string, wherein with the telescoping member in the torque-transmitting configuration rotation of the casing running tool at the upper end of the inner work string allowing torque to be transmitted through the inner work string and the telescoping member to rotate the connection at the lower end of the inner work string to at least one of engage the connection with the lower end of the casing string and disengage the connection from the lower end of the casing string, and with the telescoping member in the torque-isolating configuration rotation of the casing running tool at the upper end of the inner work string causing the casing running tool to at least one of engage with the upper end of the casing string and disengage from the upper end of the casing string without rotating the connection at the lower end of the inner work string.

9. The assembly of claim 8, wherein the connection is a collet.

10. Downhole apparatus comprising:

(a) a first connection;

(b) a second connection; and (c) a telescoping member coupling the first connection and the second connection, the telescoping member having a torque-transmitting configuration and a torque-isolating configuration, the telescoping member comprising: a first part including a cylindrical profiled section and a splined profile section, the splined profile section having axially extending spline teeth which extend radially from a body, and a second part including a splined torque bushing having axially extending spline grooves which extend radially into a cylindrical surface, wherein with the telescoping member in the torque-transmitting configuration the splined torque bushing is engaged with the splined profile section and the axially extending spline teeth of the splined profile section extend into the axially extending spline grooves of the splined torque bushing, whereby torque is transmittable from the first connection to the second connection via the telescoping member, and wherein with the telescoping member is in the torque-isolating configuration the splined torque bushing is disengaged from the splined profile section and the cylindrical surface of the splined torque bushing is engaged with the cylindrical profiled section, whereby the splined torque bushing is rotatable on the cylindrical profiled section and no torque is transmittable from the first connection to the second connection.

11. An assembly for running and cementing a casing string in a drilled bore, the assembly comprising: a casing string having an upper end and a lower end; an inner work string incorporating the downhole apparatus of claim 10 towards a lower end thereof, the inner work string extending through the casing string between the upper end and the lower end of the casing string; a connection at a lower end of the inner work string; and a casing running tool coupled to an upper end of the inner work string, wherein with the telescoping member in the torque-transmitting configuration rotation of the casing running tool at the upper end of the inner work string allowing torque to be transmitted through the inner work string and the telescoping member to rotate the connection at the lower end of the inner work string to at least one of engage the connection with the lower end of the casing string and disengage the connection from the lower end of the casing string, and with the telescoping member in the torque-isolating configuration rotation of the casing running tool at the upper end of the inner work string causing the casing running tool to at least one of engage with the upper end of the casing string and disengage from the upper end of the casing string without rotating the connection at the lower end of the inner work string.

12. A method of controlling the transfer of torque between a first connection and second connection, the method comprising:

coupling a first connection and a second connection with a telescoping member comprising: a first part including a cylindrical profiled section and a splined profile section, and a second part including a splined torque bushing;

configuring the telescoping member in a torque-transmitting configuration with the splined torque bushing engaged with the splined profile section and transmitting torque from the first connection to the second connection via the telescoping member, and configuring the telescoping member in a torque-isolating configuration with the splined torque bushing disengaged from the splined profile section and engaged with the cylindrical profiled section and rotating the first connection relative to the second connection.

13. The method of claim 12, comprising extending the telescoping member to the torque-transmitting configuration and contracting the telescoping member to the torque-isolating configuration.

14. The method of claim 12, comprising reconfiguring the telescoping member from the torque-transmitting configuration to the torque-isolating configuration by placing the telescoping member in compression.

15. The method of claim 14, comprising reconfiguring the telescoping member from the torque-isolating configuration to the torque-transmitting configuration by placing the telescoping member in tension.

16. The method of claim 12, comprising configuring the telescoping member in the torque-isolating configuration and engaging a cylindrical surface of the splined torque bushing of the second part of the telescoping member with the cylindrical profiled section of the first part of the telescoping member.

17. The method of claim 12, comprising translating fluid through the telescoping member and providing pressure containment between the first and second parts of the telescoping member by maintaining a seal stack assembly on the first part of the telescoping member in contact with a polished bore receptacle of the second part of the telescoping member.

18. The method of claim 12, comprising providing the telescoping member in an inner work string coupled at an upper end to a casing running tool and extending into a casing string and, with the telescoping member in the torque-transmitting configuration, rotating the casing running tool and transmitting torque through the inner work string and the telescoping member to rotate a connection at a lower end of the inner work string to at least one of engage the connection with a lower end of the casing string and disengage the connection from the lower end of the casing string.

19. The method of claim 18, comprising configuring the telescoping member in the torque-isolating configuration and rotating the casing running tool to at least one of engage the casing running tool with an upper end of the casing string and disengage the casing running tool from the top of the casing string without rotating the connection at the base of the inner work string.

* * * * *